United States Patent [19]

Peach

[11] 3,982,424

[45] Sept. 28, 1976

[54] APPARATUS FOR MEASURING METACENTRIC HEIGHT OF A SHIP

[76] Inventor: Robert W. Peach, 888 Pine Trail, Arnold, Md. 21012

[22] Filed: Jan. 13, 1976

[21] Appl. No.: 648,637

[52] U.S. Cl. ..... 73/65

[51] Int. Cl.[2] ..... B63B 9/08

[58] Field of Search ..... 73/65; 324/182

[56] References Cited

UNITED STATES PATENTS

| | | | |
|---|---|---|---|
| 1,859,546 | 5/1932 | Wilson | 73/65 |
| 2,431,405 | 11/1947 | Kreitner et al. | 73/65 |

*Primary Examiner*—James J. Gill

*Assistant Examiner*—Anthony V. Ciarlante

*Attorney, Agent, or Firm*—Scrivener Parker Scrivener and Clarke

[57] ABSTRACT

Apparatus for measuring the metacentric height of a vessel by the use of an electrical signal generator which may be an armature stabilized relative to earth by a pendulus precision gyro and a stator fixed to the vessel to provide alternately polarized signals as the vessel rolls in response to even small roll inducing forces, such as wind, harbor waves, etc. A charge is allowed to build up on a capacitor in response to a first polarized signal as the vessel rolls in one direction and be discharged from the capacitor in response to a second polarized signal as the vessel rolls in the opposite direction to produce a signal representative of total roll period which signal actuates an indicator calibrated in terms of metacentric height.

6 Claims, 5 Drawing Figures

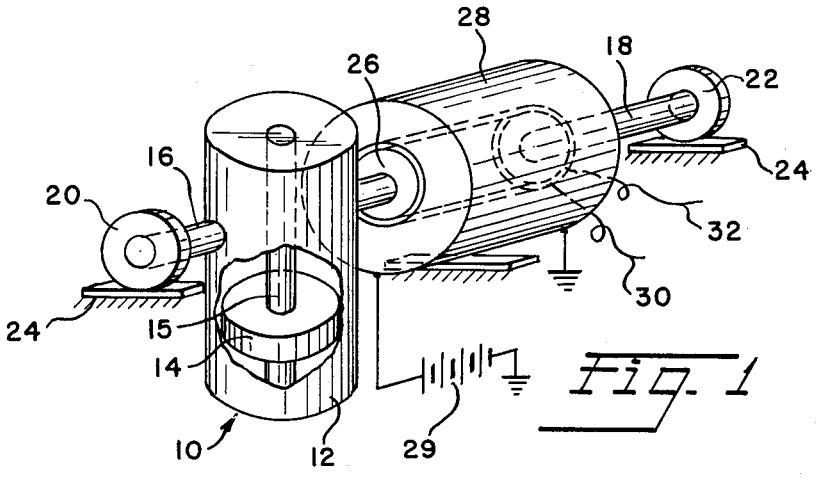
Fig. 1
Fig. 2
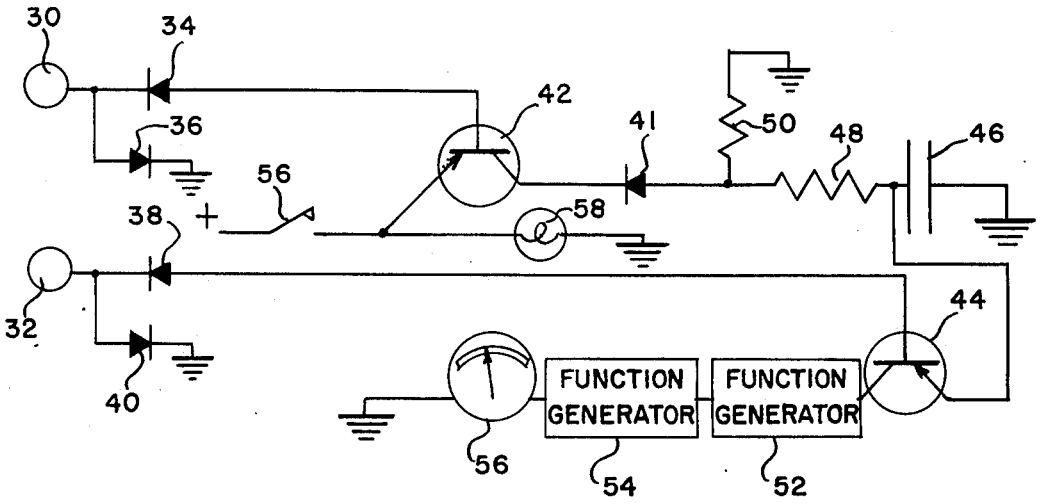

Fig. 3
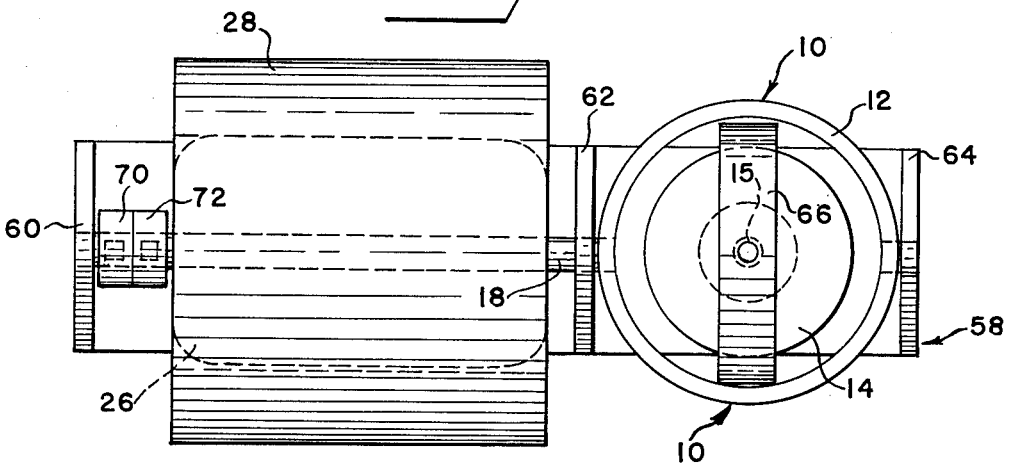
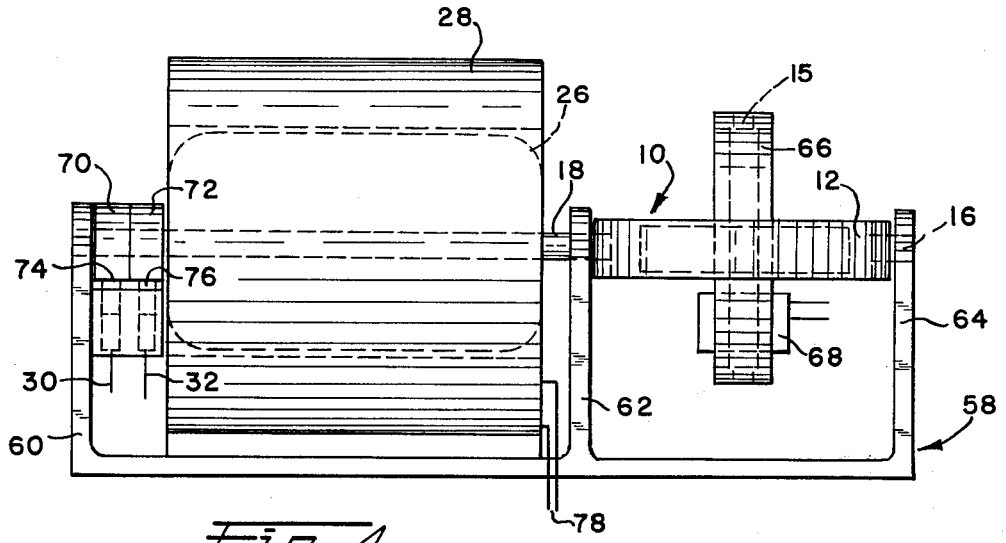
Fig. 4
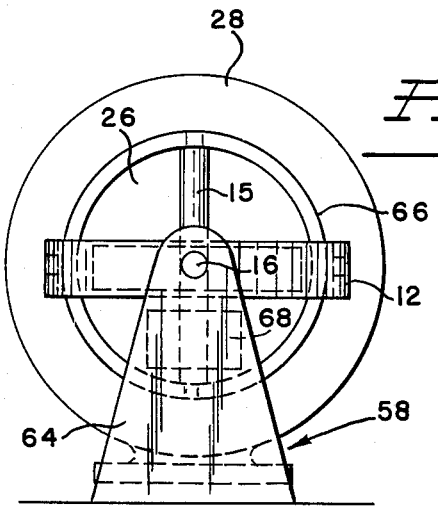
Fig. 5

APPARATUS FOR MEASURING METACENTRIC HEIGHT OF A SHIP

This invention relates to ship stability indicating means and more particularly to improved means for automatically determining the metacentric height of a vessel.

A ship has designed into it a certain stability as measured by its metacentric height. In loading the cargo or operating the ship this metacentric height can be altered by the placement of high or low loads and consumption of fuel, water and stores. The first mate is usually responsible for the loading and stability but has to make lengthy calculations to determine what is the stability of the ship with the existing and/or proposed cargo and consumable loads.

It has heretofore been proposed to derive the metacentric height of a vessel automatically as a function of the ship's rolling period by measuring the length of time it takes for a vessel to complete a full roll cycle from a datum position, say, full to port, full to starboard and then full to port. With the radius of gyration of the vessel having been pre-determined and being essentially constant regardless of vessel loading the metacentric height can be derived from the known formula:

$$GM = \frac{1}{g} \quad \frac{2\pi k}{T} \quad ^2 \text{ or}$$

$$= \frac{1.23k^2}{T^2}$$

where $g$ is the accelation of gravity, $k$ is the known radius of gyration and $T$ the period of roll as defined above. With $k$ being essentially constant it can be seen that a suitable meter can be calibrated to give a direct reading of metacentric height with its sole input being a function of the roll period.

A prior known system for deriving metacentric height as a function of roll period relies on the use of a pendulum so arranged that after rolling motion of predetermined extent of the vessel has been induced in calm waters by on-board, athwartship swinging of a weight, a switch is automatically closed after slight roll in one direction to start a stop-watch which continues to run until the vessel has completed its natural roll in the one direction, then completed its roll in the opposite direction and returned to the position where the watch was first started at which point the mechanism operates to stop the watch. With the watch running during the full roll cycle, a pointer attached to the watch is moved past calibrations of metracentric height which calibrations take into account the known radius of gyration of the vessel to give a direct reading of the metercentric height at the calibration where the pointer is stopped.

The difficulty with the prior system is that it requires calm waters and the use of the on-board swinging weight to induce a sufficient angle of roll to provide a reading, natural wave action producing spurious results. Further, the use of a mechanical swinging pendulum to sense the roll of a vessel requires that a pronounced roll of predetermined minimum extent be induced in the vessel by use of the swinging weight, which is time consuming, dangerous and only usable, as a practical matter, sporadically so that the vessel could possibly become improperly loaded between tests. Additionally, pronounced rolling can produce inaccuracies in its own right inasmuch as the angle of roll should be limited to a degree where for small roll angles, $\theta$ may be substituted for sin $\theta$ in the differential equation of motion of a rolling ship which is:

$$\frac{d^2\theta}{dt^2} + \frac{g\,GM}{k^2}\sin\theta = 0$$

where $\theta$ is the angle of roll and the other factors are as defined above.

The broad object of the present invention is to provide improved apparatus for automatically determining the metacentric height of a vessel without requiring on-board induced rolling.

More particularly it is an object of the invention to provide improved automatic metacentric height determining apparatus based on vessel roll period with the apparatus being so sensitive that it can determine metacentric height based on the slightest roll of the vessel caused, for example, by wind, small harbor waves, loading of the vessel etc.

Other objects and their attendant advantages will become apparent as the following detailed description is read in conjunction with the accompanying drawings wherein:

FIG. 1 is a schematic perspective view of roll sensing means constructed in accordance with the present invention;

FIG. 2 is a diagram of a circuit which may be employed in conjunction with the apparatus schematically illustrated in FIG. 1;

FIG. 3 is a top plan view of a preferred roll sensor of the type incorporated in the schematically shown apparatus of FIG. 1;

FIG. 4 is a side elevational view of the sensor of FIG. 3; and

FIG. 5 is an end elevational view of the sensor of FIG. 3.

Referring now to the drawings and particularly FIG. 1, a preferred roll sensor is schematically shown as comprising a pendulous precision gyroscope 10 including a housing 12 and a rotor 14 rotatable about a vertical axis on a shaft 15. The housing 12 is connected by a stub shaft 16 and an elongated shaft 18, whose aligned horizontal axes are normal to the axis of rotor shaft 15, to respective bearings 20, 22 fixed to the vessel in the plane of the fore and aft center line. The elongated shaft 18 carries a rotary armature 26 which co-operates with a stator 28 energized by a DC source 29.

It will be apparent that as the ship rolls, the gyroscope 14 maintains an upright fixed position relative to the earth causing the armature 26, rigidly attached by shaft 18 to the gyroscope housing 12 to have an oscillatory motion within the stator which corresponds precisely with the rolling motion of the vessel. The polarity of the current generated at the leads 30, 32 due to the relative rotation between the stator and armature alternates with a period equal to the roll period; that is to say, with the vessel at the end of its roll to port, for example, the current at, say, lead 30 is initially zero but becomes positive the moment the ship starts to roll to starboard and remains positive until the roll to starboard is completed whereupon the current returns to zero and thereafter is negative at lead 30 until the vessel completes its next roll to port at which point the current again falls to zero. The polarity of the current at lead 32 is opposite to that at lead 30.

Referring now to FIG. 2, the current in leads 30 and 32 are connected into the meter circuit shown. The circuit comprises five diodes 34, 36, 38, 40 and 41; two transistors 42, 44; a capacitor 46; a pair of resistors 48, 50; first and second function generators 52, 54; a meter 56 calibrated in direct reading of metacentric height, a control switch 56 and a signal light 58 for indicating when the equipment is energized.

In operation, let it be assumed that the vessel is at its full port roll position and is starting its roll to starboard so that the signal is just starting positive at the lead 30 in FIGS. 1 and 2. Diode 34 allows this positive signal to flow to the base of transistor 42 and at the same time diode 40 allows completion of the circuit by connecting the negative signal at lead 32 to ground. When the base of transistor 42 becomes positive, a signal is transmitted through transistor protection diode 41 to capacitor 46 where the charge builds up on the capacitor, due to the action of the resistors 48, 50, in proportion to the time the signal is positive at the base of transistor 42, that is, throughout the half period of roll as the vessel rolls from full port to full starboard. On rolling in the opposite direction from full starboard to port, the signal on lead 30 becomes negative, transistor 42 becomes non-conductive and the signal at lead 32 becomes positive. Diode 38 allows this signal to pass to the base of transistor 44 to render the latter conducting so that the charge built up on the capacitor 46 may now pass through transistor 44 to the first function generator 52.

So long as the base of transistor 44 is positive, which is the entire time the vessel is rolling from full starboard to full port, the transistor 44 is conductive and the resulting signal input to the function generator 52 corresponds to the full roll period. The function generator 52 is of a known type designed to square the roll period signal to produce a signal $T^2$ which is transmitted to the function generator 54 designed to produce a signal representative of the reciprocal of $T^2$ or $(1/T^2)$. This signal is fed to the meter 56, whose needle moves relative to calibrations on the meter dial in terms of metacentric height, with these calibrations taking into account the substantially constant value $k$ representative of the radius of gyration of the particular vessel on which the invention is employed.

The roll sensor schematically shown in FIG. 1, is shown in greater detail in FIGS. 3, 4 and 5 where corresponding parts to those of FIG. 1 bear the same reference numerals. As shown, the sensor includes a bracket 58 which is adapted to be fixed to the vessel in the plane of its for and aft centerline. The bracket 58 has 3 upstanding arms 60, 62, 64 whose upper ends define bearings in which the stub-shaft 16 and the elongated shaft 18 are journaled. The shaft 15 of gyro 10 is driven by a motor 68 and is journaled in a bracket 66 pivoted in the gyro housing 12 at right angle to the axes of the shafts 16 and 18.

The stator 28 is fixed to the base of the bracket 58 and the armature 26 is fixed to the shaft 18 which also carries between the bracket arm 60 and the stator 28 a pair of slip rings 72, 74 having respective electrical connections with opposite ends of the armature 26 and engaged by brushes 74, 76 to which the leads 30, 32 are respectively connected. Leads 78 serve to connect the stator to the DC source 29.

Though the roll sensor illustrated in the FIGS. 3–5 is preferred the invention is susceptible of other means for generating through the use of a precision gyroscope a signal representative of the roll period of the ship. For example, a ring or doughnut solenoid could be attached to the gyroscope with fixed pickup coils wrapped around the solenoid. Alternatively an air type capacitor could be used with some of its plates fixed and some attached to the gyroscope. The latter arrangement would require a different type of electrical circuit for timing the charge cycle on the sensing capacitor and the signal would be twice the roll period. In yet another system, the wave shape signal sensed by the gyroscopic sensor could be compared with varying known wave shapes provided by a suitable signal generator to produce an output signal proportional to the roll period when the sensed signal matches the known generator signal.

From the foregoing it can be seen that the invention is susceptible of a variety of combinations and modifications which utilize a roll signal sensed by a precision gyroscope to deliver a signal at the meter proportional to the roll period which, in accordance with the basic equation of roll can be squared and inverted to give a measure of stability.

What is claim is:

1. Ship stability measuring apparatus comprising an indicator arranged to indicate values of metacentric height, roll sensing means for generating a first electrical signal of one polarity throughout the period a vessel rolls from a first to a second extremity and a second electrical signal of opposite polarity throughout the period the vessel rolls from said second to said first extremity, electrical charge receiving means and means for charging said electrical charge receiving means in response to said first electrical signal, means for discharging said electrical charge receiving means in response to said second electrical signal, means for generating a signal in response to the discharging charge from said charge receiving means which is representative of the total period the vessel rolls from said first to said second and then to said first extremity, and means for connecting said last named means to said indicator to indicate the magnitude of said last mentioned signal in terms of metacentric height.

2. The ship stability measuring apparatus of claim 1 wherein said roll sensing means includes a precision gyroscope and electrical signal generating means having a first part operatively connected to said gyroscope so that its angular orientation relative to the earth may be maintained constant, and a second part adapted to be rigidly connected to said vessel so as to roll therewith and be moveable thereby relative to said first part for generating said first and second electrical signals.

3. The ship stability measuring apparatus of claim 2 wherein said precision gyroscope is a pendulousgyroscope rotatable about a vertical axis.

4. The ship stability measuring apparatus of claim 3 wherein the two parts of the electrical signal generating means comprises co-axial stator and armature members relatively rotatable about a horizontal axis, said pendulous precision gyro being connected to one of said members and the other of said members being adapted to be rigidly connected to a ship.

5. The ship's stability measuring apparatus of claim 1 wherein the charge receiving means is a capacitor and the means responsive to the generated first and second signals are first and second transistors, respectively,

6. The ship's stability measuring means of claim 5 wherein the last mentioned signal generating means comprises a first function generator whose input is a signal representative of the total roll period and whose output is a signal representative of the total roll period squared, and a second function generator whose input is the last mentioned signal and whose output is a signal representative of the reciprocal of the roll period squared, and said indicator is a meter whose input is the last mentioned signal and which is calibrated in units of metacentric height taking into account the radius of gyration of a particular vessel on which said apparatus is employed.

* * * * *